US006823558B2

(12) United States Patent
Lee

(10) Patent No.: US 6,823,558 B2
(45) Date of Patent: Nov. 30, 2004

(54) BUSHING SEAL IN A VACUUM CLEANER BRUSH HAVING A FLOOR CLOTH

(75) Inventor: Byung-jo Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 313 days.

(21) Appl. No.: 10/079,198

(22) Filed: Feb. 20, 2002

(65) Prior Publication Data

US 2003/0037409 A1 Feb. 27, 2003

(30) Foreign Application Priority Data

Aug. 21, 2001 (KR) ..... 2001-50144

(51) Int. Cl.[7] ..... A47L 5/30
(52) U.S. Cl. ..... 15/391; 15/385
(58) Field of Search ..... 15/383, 385, 391, 15/97.1, 98

(56) References Cited

U.S. PATENT DOCUMENTS

| | | | | |
|---|---|---|---|---|
| 3,451,087 A | * | 6/1969 | Jepson et al. | 15/49.1 |
| 4,589,161 A | | 5/1986 | Kochte et al. | |
| 4,688,289 A | * | 8/1987 | Urakami | 15/98 |
| 4,773,120 A | * | 9/1988 | Wang | 15/344 |
| 4,791,694 A | * | 12/1988 | Itaya et al. | 15/97.1 |
| 4,965,905 A | * | 10/1990 | Kitahata et al. | 15/97.1 |
| 6,185,781 B1 | | 2/2001 | Miller et al. | |
| 6,421,869 B1 | * | 7/2002 | Olsson | 15/50.1 |
| 6,571,423 B1 | * | 6/2003 | Lijzenga et al. | 15/385 |

FOREIGN PATENT DOCUMENTS

| | | |
|---|---|---|
| CH | 165489 | 2/1934 |
| DE | 3742785 | 12/1987 |
| DE | 3742785 | 6/1989 |
| EP | 1138243 | 10/2001 |
| GB | 2214416 | 9/1989 |
| JP | 8228974 | 9/1996 |

* cited by examiner

*Primary Examiner*—Terrence R. Till
(74) *Attorney, Agent, or Firm*—Ladas & Parry

(57) ABSTRACT

A vacuum cleaner brush having a case and a rotary element on which a floor cloth is attached. The rotary element is rotatably disposed on a lower portion of the case. A housing is disposed in the case, having a motor disposed therein, the motor rotatably driving the rotary element. A first and second bushing into which the driven shaft of the rotary element is provided with a blocking element protruding from a bottom surface of the case in the shape of a cylinder along a circumference of the first bushing for preventing dust and dirt from flowing into the first bushing. A ring element protrudes from an upper and inner circumference of the first bushing toward an outer circumference of the driven shaft, the ring element prevents dust and dirt from flowing into the housing. Dust and dirt are thereby prevented from flowing into the housing and damaging various components such as the motor and gears in the housing.

6 Claims, 5 Drawing Sheets

BUSHING SEAL IN A VACUUM CLEANER BRUSH HAVING A FLOOR CLOTH

BACKGROUND OF THE INVENTION

1. Field of the Invention

The present invention relates generally to a vacuum cleaner, and more particularly, to a bushing seal in a vacuum cleaner brush having a floor cloth attached to a bottom surface thereof.

2. Background Art

The conventional vacuum cleaner has a structure that draws air in through a nozzle by a powerful suction force, collecting minute dust and dirt from the surface being cleaned, which becomes entrained in the air and which is then filtered through a dust-collecting bag or an exhaust filter. The then cleaned air is discharged through an exhaust port disposed in a cleaner body.

As shown in FIG. 1, a conventional vacuum cleaner is provided with a dust-collecting chamber (not shown), in which an exhaust filter is mounted, disposed at a front portion of a cleaner body 1, and a fan motor (not shown) disposed at a rear portion of the cleaner body 1, for generating a suction force. Also, the dust-collecting chamber of the cleaner body 1 is consecutively connected to a hose 3, a handle portion 5, and an extension pipe 7, which can be separated from each other. At a front end of the extension pipe 7, a brush 100 is provided. The reference numeral 6 indicates a driving on-off switch.

Recently, vacuum cleaners have been developed having a floor cloth attached to a bottom surface of the brush 100 used to draw dust in and simultaneously to perform a wet cleaning. FIG. 2 shows an example of the brush 100 to which such a floor cloth is attached.

As shown in FIG. 2, the brush 100 comprises a case 10 having an upper case 11 and a lower case 12, a connector 20, joined to a rear portion of the case 10, and to provide a connection to the extension pipe 7, a pair of rotary elements 30, rotatably disposed on a bottom surface of the lower case 12, a rotation driving portion, disposed in the case 10 for rotatably driving the rotary elements 30, and floor cloths 60 removably connected to the rotary elements 30.

Each rotary element 30 has a driven shaft 31 protruding from the center thereof in the shape of a hollow cylinder.

The lower case 12 comprises a suction port 13, which is disposed at a front portion of the lower case 12, for drawing in dirt-laden air therethrough, and a pair of first bushings 14 protruding upwardly from a bottom surface of the lower case 12 that are in the shape of a cylinder, into each of which one of the driven shafts 31 is inserted.

The rotation driving portion comprises a housing 40 having an upper housing 41 and a lower housing 42, a bi-directional rotation motor 43, disposed in the housing 40, and having a pair of rotary shafts rotating bi-directionally, a pair of worm gears 44 respectively connected to the rotary shafts of the bi-directional rotation motor 43, a pair of worm wheels 45, respectively engaged with the worm gears 44, and a driving shaft 46 disposed at a lower portion of the each worm wheel 45 and connected to the driven shaft 31 of the rotary element 30. The lower housing 42 comprises a pair of second bushings 47 protruding upwardly from a bottom surface of the lower housing 42 that are in the shape of a cylinder.

As shown in FIG. 3, each first bushing 14 of the lower case 12 and each second bushing 47 of the lower housing 42 are disposed adjacent to and align with each other. The driven shaft 31 of the rotary element 30 is inserted into the first bushing 14 and the second bushing 47. Each driving shaft 46 of the worm wheels 45 is fitted in the driven shaft 31 of the rotary element 30 so that the driving shaft 46 rotates in association with the driven shafts 31.

In the brush 100, as constructed above, if the bi-directional rotation motor 43 is driven, the worm gears 44 and the worm wheels 45 rotate, resulting in rotation of the driving shaft 46. Due to the rotation of the driving shaft 46, the driven shafts 31 rotate resulting in rotation of the rotary elements 30. The floor cloths 60 attached to the bottom surfaces of the rotary elements 30 rotate in association with the rotary elements 30 and wipe the dirt off a surface to be cleaned. Simultaneously, the dust-laden air is drawn in the brush 100 through the suction port 13, and then flows into the dust-collecting chamber of the cleaner body 1 through the connector 20.

As shown in FIGS. 1-3, in the aforementioned conventional brush 100, since the bottom surface of the lower case 12 and the top surface of the rotary element 30 are spaced apart from each other, the dust and dirt may flow to the first and second bushings 14 and 47 through a space between the bottom surface of the lower case 12 and the top surface of the rotary element 30. Therefore, there is a disadvantage in that the dirt and dust may collect on the bushings 14 and 47, thereby causing the rotary element 30 to not rotate smoothly, and possibly causing the bi-directional rotation motor 43 to be subjected to an overload and become damaged.

The conventional brush 100 has another disadvantage in that the dust and dirt which flows into the first and second bushings 14 and 47 also may flow into the housing 40 through a space between a bottom surface of the worm wheel 45 and an upper end of the second bushing 47, thereby damaging the teeth of the worm gears 44 and worm wheels 45.

SUMMARY OF THE INVENTION

The present invention solves the above-mentioned problems. An object of the present invention is to provide a vacuum cleaner brush capable of preventing dust and dirt from flowing into the rotation driving portion that rotatably drives the floor cloths.

The above object of the present invention is achieved by providing a vacuum cleaner brush comprising a case, a floor cloth rotatably disposed on a bottom surface of the case, a rotation driving portion disposed in the case for rotatably driving the floor cloth, and blocking means for blocking the gap between the bottom surface of the case and the upper surface of the floor cloth to prevent dust from flowing into the rotation driving portion through the rotation center of the floor cloth.

Here, the blocking means protrudes from the bottom surface of the case in the shape of a cylinder along the circumference of the rotation center of the floor cloth.

Also, the above object of the present invention is achieved by providing a vacuum cleaner brush comprising a case, a rotary element being rotatably disposed at a lower portion of the case and having a rotary shaft, a floor cloth disposed on the bottom surface of the rotary element, a housing being disposed in the case and having a separate space from the case, a motor disposed in the housing for rotatably driving the rotary element, a first bushing protruding from an inner bottom surface of the case in the shape of a cylinder, into which the rotary shaft of the rotary element is inserted, a second bushing protruding from an inner bottom surface of the housing in the shape of a cylinder, the second bushing being communicated with the first bushing, and a blocking element protruding from the bottom surface of the case in the shape of a cylinder along a circumference of the first bushing, for preventing dust from flowing into the first bushing.

Here, the brush further comprises a bending element extended from an upper end of the first bushing, a cross section of the bending element showing a crank shape. It is preferable that on a bent portion of the bending element there is provided a chamfered surface such that the rotary shaft is easily inserted.

Also, the above object of the present invention is achieved by providing a vacuum cleaner brush comprising a case, a rotary element being rotatably disposed at a lower portion of the case and having a rotary shaft, a floor cloth disposed on the bottom surface of the rotary element, a housing being disposed in the case and having a separate space from the case, a motor disposed in the housing for rotatably driving the rotary element, a first bushing protruding from an inner bottom surface of the case in the shape of a cylinder, into which the rotary shaft of the rotary element is inserted, a second bushing protruding from an inner bottom surface of the housing in the shape of a cylinder, the second bushing being communicated with the first bushing, and a ring element protruding from an upper and inner circumference of the first bushing toward an outer circumference of the rotary shaft, for preventing dust from flowing into the housing.

Here, it is preferable that the brush further comprises an inner tube extending from an end of the ring element in the shape of cylinder to be in parallel relation with the outer circumference of the rotary shaft, and on a connecting portion of the ring element, the inner tube being provided with a chamfered surface for the easy insertion of the rotary shaft.

According to the brush as constructed above, due to the presence of the blocking element, the bending element, and the ring element, the dust and dirt can be prevented from flowing into the housing. Dust and dirt are effectively sealed from flowing into the housing. Accordingly, the various components of the rotation driving portion such as a motor can be prevented from damage.

BRIEF DESCRIPTION OF THE DRAWINGS

The above object and characteristic of the present invention will be more apparent by describing a preferred embodiment of the present invention with reference to accompanied drawings, in which.

DETAILED DESCRIPTION OF THE PREFERRED EMBODIMENT

Hereinafter, a brush according to a preferred embodiment of the present invention will be described in greater detail with reference to the accompanying drawings.

Figure 4:
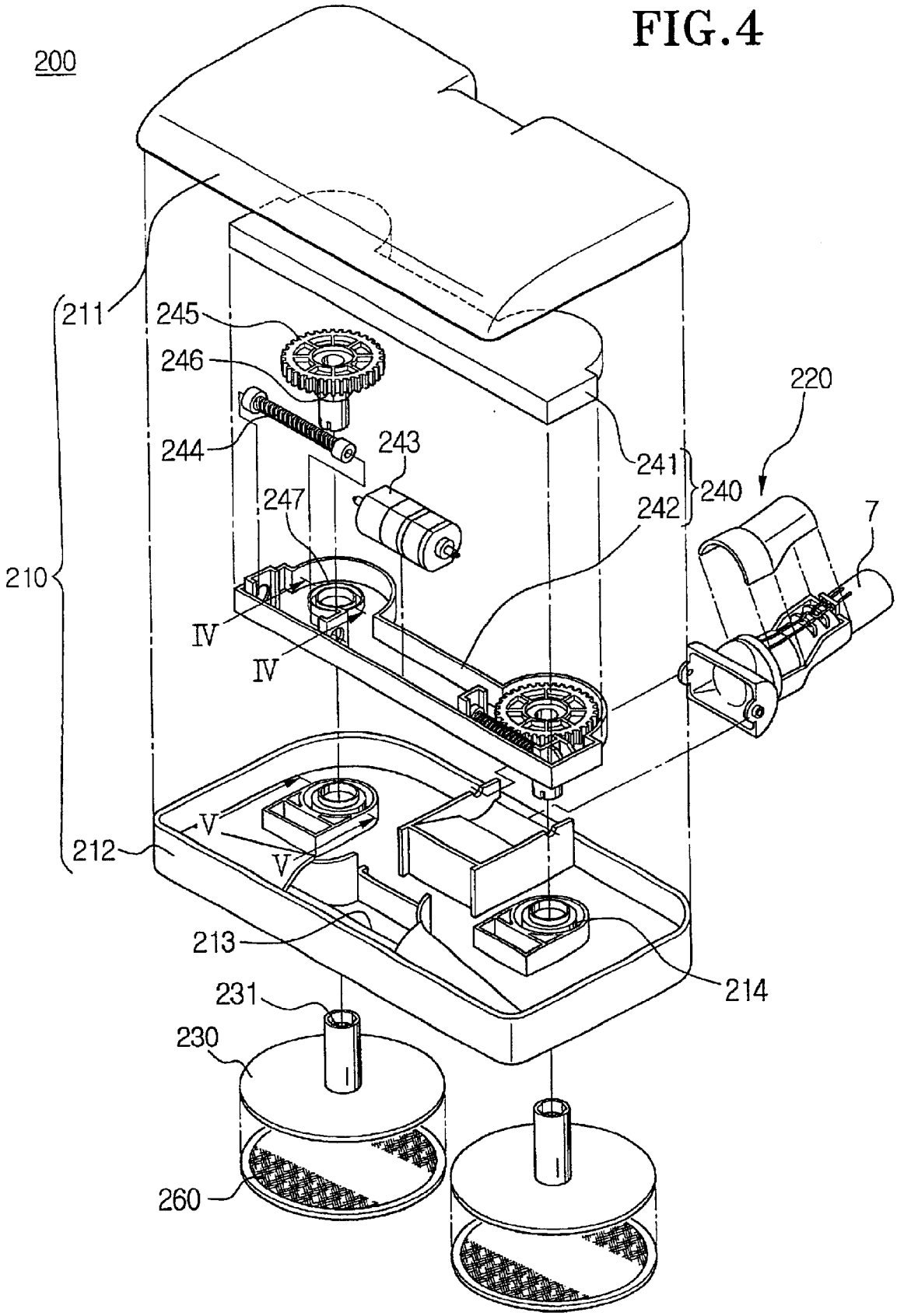
FIG. 4 is an exploded and perspective view showing a brush in accordance with a preferred embodiment of the present invention.

According to the present invention, as shown in FIG. 4, the brush 200 comprises a case 210 having an upper case 211 and a lower case 212, a connector 220 joining the rear portion of the case 210 to an extension pipe 7, a pair of rotary elements 230, rotatably disposed on a bottom surface of the lower case 212, a rotation driving portion disposed in the case 210 for rotatably driving the rotary elements 230, and floor cloths 260 removably attached to the rotary elements 230.

The rotary elements 230 have driven shafts 231 protruding upwardly from the centers thereof in the shape of a hollow cylinder.

The lower case 212 comprises a suction port 213, which is disposed at the front portion of the lower case 212 for drawing in dirt-laden air therethrough, and a pair of first bushings 214 protruding upwardly from the bottom surface of the lower case 212 in the shape of a cylinder, into which the driven shafts 231 of the rotary elements 230 are inserted.

The rotation driving portion comprises a driver housing 240 having an upper housing 241 and a lower housing 242, a bi-directional rotation motor 243 being disposed in the housing 240 and having a pair of rotary shafts rotating bi-directionally, a pair of worm gears 244, respectively connected to the both rotary shafts of the bi-directional rotation motor 243, a pair of worm wheels 245, respectively engaged with the worm gears 244, and driving shafts 246 disposed at lower portions of the worm wheels 245 and connected to the driven shafts 231. The lower housing 242 comprises a pair of second bushings 247 protruding upwardly from the bottom of the lower housing 242 in the shape of a cylinder.

Figure 5:
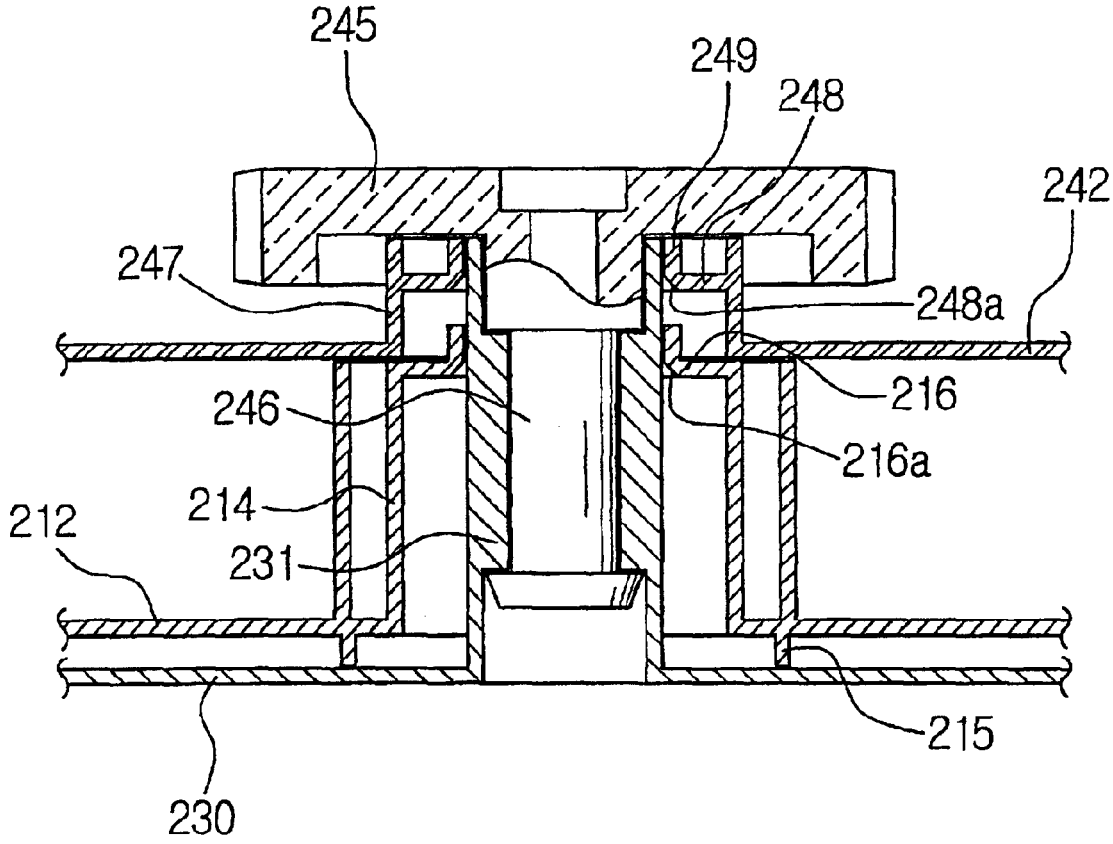
FIG. 5 is a partial cross sectional view taken on lines IV—IV and V—V of FIG. 4, and shown in an assembled condition.

As shown in FIG. 5, after assembly, each first bushing 214 of the lower case 212 and each second bushing 247 of the upper housing 242 are located adjacent to and axially aligned with each other. Each driven shaft 231 of the each rotary element 230 is inserted into the first and second bushings 214 and 247. Each driving shaft 246 of the each worm wheel 245 is fitted into an aperture in the driven shaft 231 of the rotary element 230 and connected thereto such that, if the driving shaft 246 is rotated, the driven shaft 231 is rotated in association with the driving shaft 246.

On the bottom surface of the lower case 212 a blocking element 215 is provided which protrudes in the shape of a flanged cylinder. The blocking element 215 encloses the circumference of the first bushing 214 such that dust and dirt are prevented from flowing into the first bushing 214, and thus reducing or eliminating the gap between the bottom surface of the lower case 212 and the top surface of the rotary element 230.

The first bushing 214 includes a bending element 216 integrally formed at an upper end thereof, a cross section of which can be seen in the shape of a crank. That is, the bending element 216 has a shape in which two rings are vertically connected to each other. The bending element 216 blocks the space between the first bushing 214 and the second bushing 247, except for the space into which the driven shaft 231 is inserted, such that dust and dirt are prevented from flowing to the second bushing 247 through the first bushing 214.

Meanwhile, an inside of a bent portion of the bending element 216 forms a chamfered surface 216*a*. Due to the presence of the chamfered surface 216*a*, the contacting area between the outer circumference surface of the driven shaft 231 and the inner circumference surface of the bending element 216 is reduced. Accordingly, the driven shaft 231 is easily inserted into the first bushing 214, and becomes less subjected to rotational loading that may be generated due to friction between the outer circumference surface of the driven shaft 231 and the inner circumference surface of the bending element 216 when the driven shaft 231 is rotated.

Meanwhile, on an upper and inner circumference of the second bushing 247 a ring element 248 is provided which protrudes toward the driven shaft 231. At an end of the ring element 248, an inner tubular element 249 is provided which extends from the ring element 248 in a parallel relation to the outer circumference of the driven shaft 231. That is, on the upper portion of the second bushing 247, a double cylinder is integrally formed, one on each of the outer side and the inner side of the upper portion of the second bushing 247. The inner tubular element 249 of the ring element 248 blocks the gap between a lower surface of each worm wheel 245 and the inner space of the second bushing 247 such that dust and dirt are prevented from flowing into the housing 240 through the second bushing 247. On a connecting portion of the ring element 248 and the inner tubular element 249, another chamfered surface 248*a* is provided. Due to the presence of this chamfered surface 248*a*, the driven shaft 231 is easily inserted into and through the second bushing 247, and is less subject to rotational loading that may be generated due to friction between the outer circumference surface of the driven shaft 231 and an inner circumference surface of the inner tubular element 249 when the driven shaft 231 is rotated.

Figure 1:
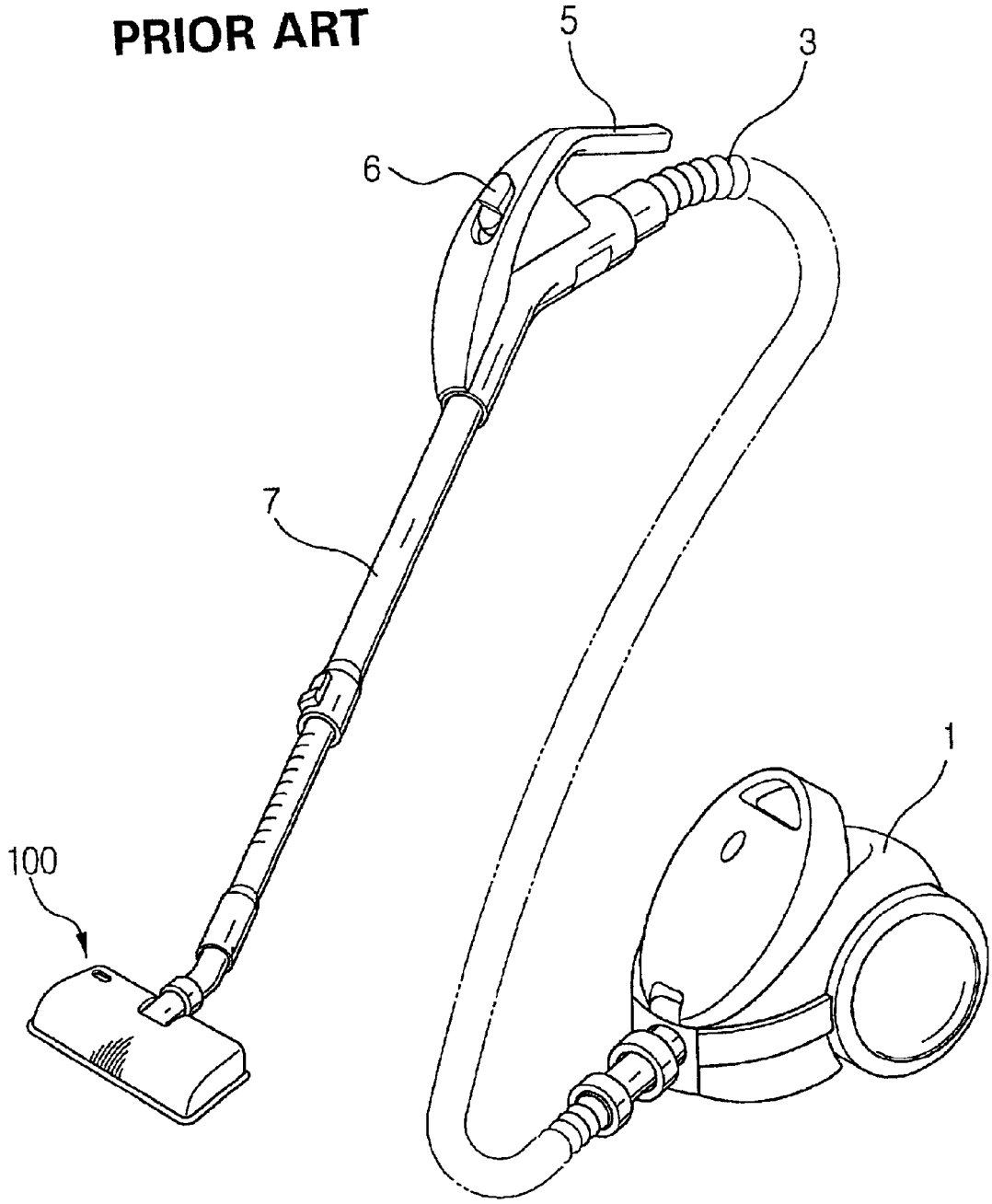
FIG. 1 is a perspective view showing a conventional vacuum cleaner.
Figure 2:
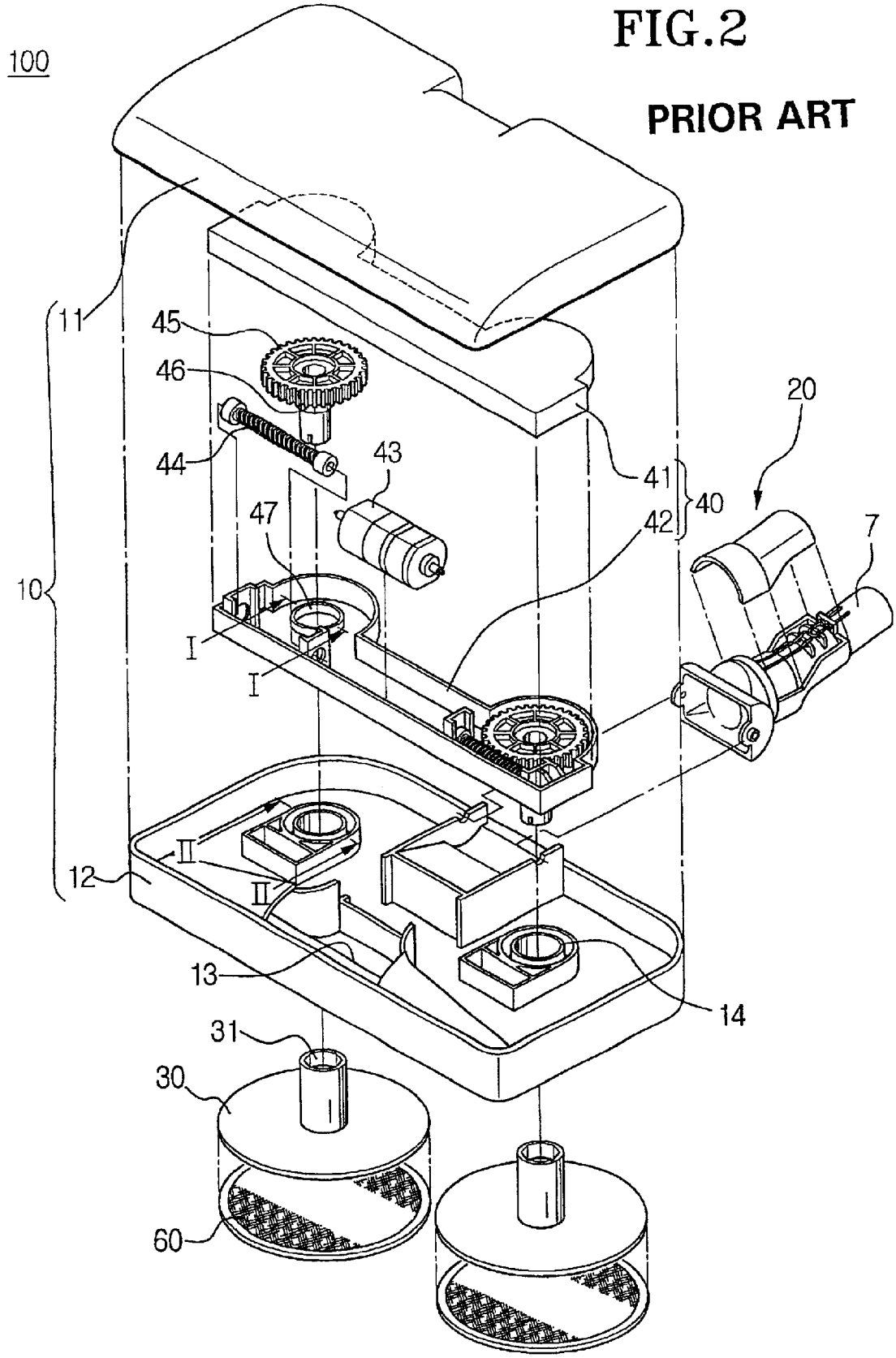
FIG.2 PRIOR ART
FIG. 2 is an exploded and perspective view showing a conventional brush having a floor cloth.
Figure 3:
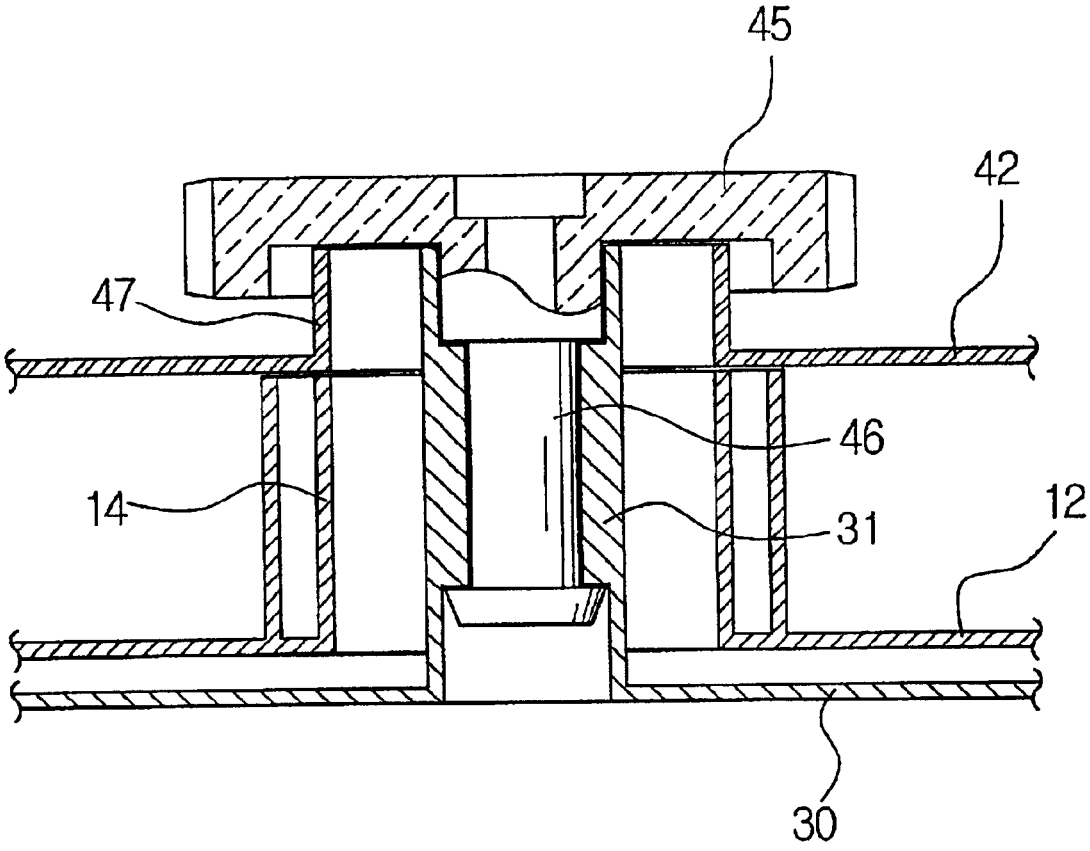
FIG.3 PRIOR ART
FIG. 3 is a partial cross sectional view taken approximately along lines I—I and II—II of FIG. 2, and shown in an assembled condition.

In the brush 200 as constructed above, if the bi-directional motor 243 is rotated, the worm gears 244 and the worm wheels 245 are rotated resulting in rotation of the driving shafts 246. Due to the rotation of the driving shafts 246, the driven shafts 231 are rotated, resulting in rotation of the rotary elements 230. Due to the rotation of the rotary elements 230, the floor cloths 260 attached to the bottom surfaces of the rotary elements 230 are rotated, wiping the dirt off the surface to be cleaned. Simultaneously, the dust-laden air is drawn into the brush 200 through the suction port 213, and then is discharged into a dust-collecting chamber (not shown) of a cleaner body 1 (FIG. 1) through the connector 220.

As described above, according to the present invention, since the blocking element 215 blocks dust and dirt from flowing into the gap between the bottom surface of the lower case 212 and the upper surface of the rotary element 230, the dust and dirt can be prevented from flowing into the housing 240 through the first bushing 214.

Also, according to the present invention, since the bending element 216 of the first bushing 214, and the ring element 248 and the inner tube 249 of the second bushing 247 block the dust and dirt, the dust and dirt, which is not blocked by the blocking element 215, can prevented from flowing into the housing 240.

Furthermore, according to the present invention, since the dust and dirt can be prevented from flowing into the housing 240, the various components of the rotation driving portion of the brush 200 can be prevented from damage as a result, such as tooth damage to the gears generated from friction between the worm gears 244 and the worm wheels 245, and the overload of the bi-directional rotation motor 243.

Although the preferred embodiment of the present invention has been shown and described above, it will be appreciated by those skilled in the art that changes, alterations modifications and substitutions may be made in the disclosed embodiment without departing from the principles and spirit of the invention, the scope of which is defined in, and limited only by, the claims and their equivalents.

What is claimed is:

1. A vacuum cleaner brush comprising:

a case;

a rotary element being rotatably disposed at a lower portion of the case and having a rotary shaft;

a floor cloth disposed on a bottom surface of the rotary element;

a housing being disposed in the case and having a separate space from the case;

a motor disposed in the housing for rotatably driving the rotary element;

a first bushing protruding from an inner bottom surface of the case in the shape of a cylinder, into and through which the rotary shaft of the rotary element is inserted;

a second bushing protruding from an inner bottom surface of the housing in the shape of a cylinder, the second bushing being adjacent to and axially aligned with the first bushing; and a blocking element protruding from a bottom surface of the case in the shape of a cylinder along a circumference of the first bushing, for preventing dust and dirt from flowing into the first bushing.

2. The brush of claim 1, further comprising a bending element extended from an upper end of the first bushing, a cross section of the bending element having a crank shape.

3. The brush of claim 2, wherein, on a bent portion of the bending element, a chamfered surface is provided such that the rotary shaft is easily inserted into the first bushing.

4. A vacuum cleaner brush comprising:

a case;

a rotary element being rotatably disposed at a lower portion of the case and having a rotary shaft;

a floor cloth disposed on a bottom surface of the rotary element;

a housing being disposed in the case and having a separate space from the case;

a motor disposed in the housing for rotatably driving the rotary element;

a first bushing protruding from an inner bottom surface of the case in the shape of a cylinder, into and through which the rotary shaft of the rotary element is inserted;

a second bushing protruding from an inner bottom surface of the housing in the shape of a cylinder, the second bushing being adjacent to and axially aligned with the first bushing; and a ring element protruding from an upper and inner circumference of the first bushing toward an outer circumference of the rotary shaft, for preventing dust and dirt from flowing into the housing.

5. The brush of claim 4, further comprising an inner tube extending from an end of the ring element in the shape of cylinder and in parallel relation with the outer circumference of the rotary shaft, a chamfered surface being provided on a connecting portion of the ring element and the inner tubular element for the easy insertion of the rotary shaft.

6. A vacuum cleaner brush comprising:

a case;

a rotary element being rotatably disposed at a lower portion of the case and having a rotary shaft;

a floor cloth disposed on a bottom surface of the rotary element;

a housing being disposed in the case and having a separate space from the case;

a motor disposed in the housing for rotatably driving the rotary element;

a first bushing protruding from an inner bottom surface of the case in the shape of a cylinder, into and through which the rotary shaft of the rotary element is inserted;

a second bushing protruding from an inner bottom surface of the housing in the shape of a cylinder, the second bushing being adjacent to and axially aligned with the first bushing;

a blocking element protruding from a bottom surface of the case in the shape of a cylinder along a circumference of the first bushing, for preventing dust and dirt from flowing into the first bushing; and a ring element protruding from an upper and inner circumference of the first bushing toward an outer circumference of the rotary shaft, for preventing dust and dirt from flowing into the housing.

* * * * *